US007549703B2

(12) United States Patent
McElhinney

(10) Patent No.: US 7,549,703 B2
(45) Date of Patent: Jun. 23, 2009

(54) ELEVATABLE-STAND-ADAPTED, WHEELED CHAIR APPARATUS

(76) Inventor: Suellen M. McElhinney, P.O. Box 182, Danville, IA (US) 52623

( * ) Notice: Subject to any disclaimer, the term of this patent is extended or adjusted under 35 U.S.C. 154(b) by 447 days.

(21) Appl. No.: 11/588,584

(22) Filed: Oct. 27, 2006

(65) Prior Publication Data

US 2007/0096525 A1 May 3, 2007

Related U.S. Application Data

(60) Provisional application No. 60/730,521, filed on Oct. 27, 2005.

(51) Int. Cl.
*A47C 1/00* (2006.01)
*A47C 3/20* (2006.01)
*A61G 3/00* (2006.01)

(52) U.S. Cl. ..... 297/344.19; 297/344.16; 280/304.1; 414/678

(58) Field of Classification Search ..... 297/344.16, 297/344.19; 280/304.1; 414/678
See application file for complete search history.

(56) References Cited

U.S. PATENT DOCUMENTS 4,192,549 A 3/1980 Petersen
4,759,684 A * 7/1988 Lanzillotta et al. ..... 414/678
4,834,411 A 5/1989 Willey et al.
5,040,939 A 8/1991 Booth
5,179,745 A * 1/1993 Hebert et al. ..... 5/620
5,472,307 A 12/1995 Kadlec et al.
6,247,718 B1 * 6/2001 Gobbers et al. ..... 280/304.1
6,463,597 B2 10/2002 Ishimura
6,866,288 B2 * 3/2005 Martin ..... 414/678 X

* cited by examiner

*Primary Examiner*—Anthony D Barfield

(57) ABSTRACT

A wheeled chair apparatus is adapted for connection with an elevatable stand, such as a hydraulic stand, and the subject wheeled chair apparatus includes a wheeled chair unit which includes a seat portion and a reclinable seat back portion connected to the seat portion. A wheel assembly is connected to the seat portion, and elevatable stand attachment means are connected to a bottom side of the seat portion. The elevatable stand attachment means are adapted for connection with the elevatable stand. By using the elevatable-stand-adapted, wheeled chair apparatus of the invention, substantial amounts of time, effort, and stress on a person in the wheeled chair are reduced in carrying out a cosmetological activity on the person, when compared with conventional procedures for handling a person in a wheeled chair when carrying out a cosmetological activity.

9 Claims, 3 Drawing Sheets

FIG 1
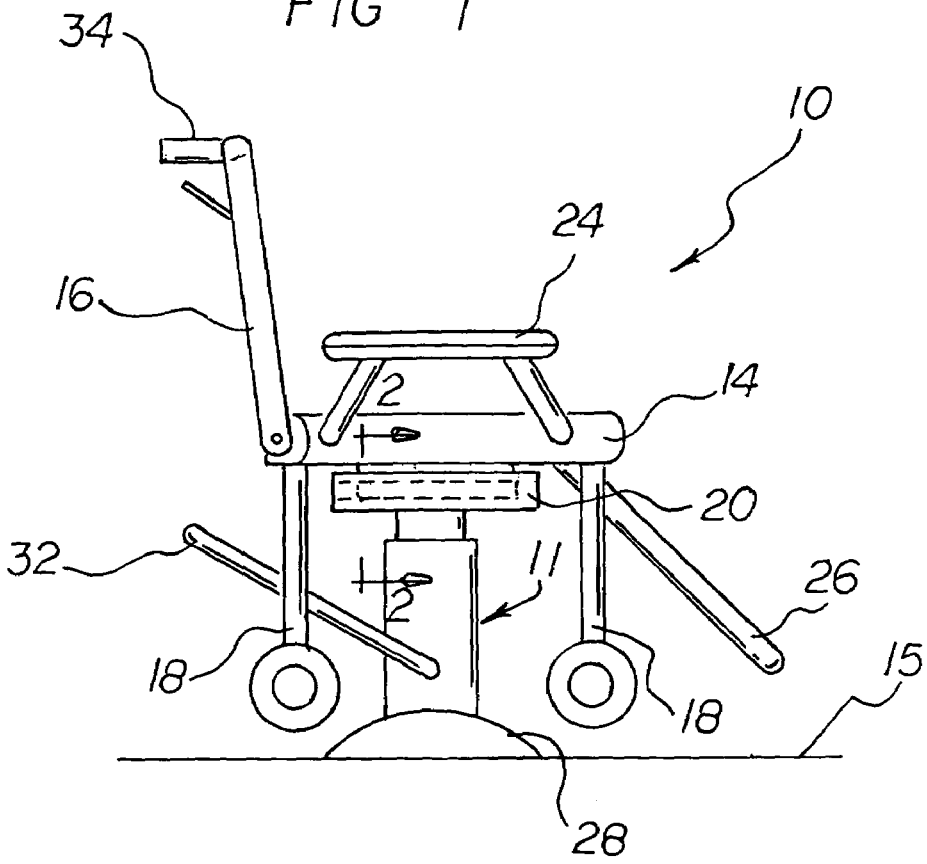
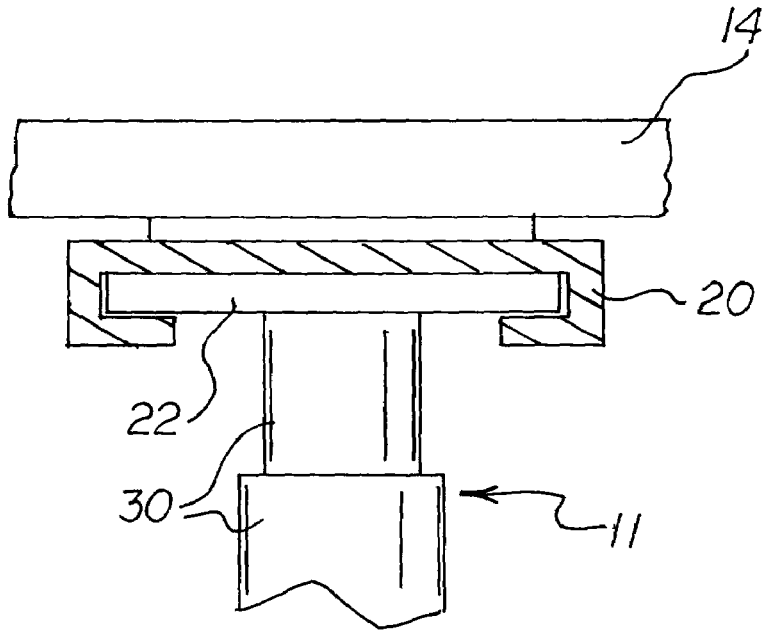
FIG 2

FIG 3
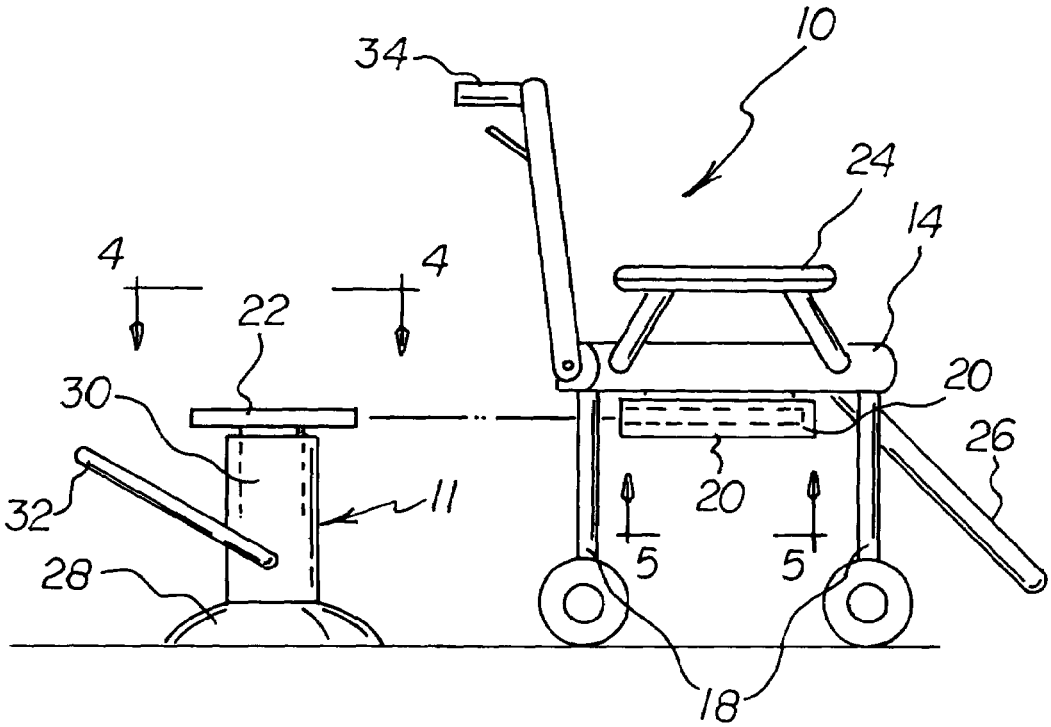
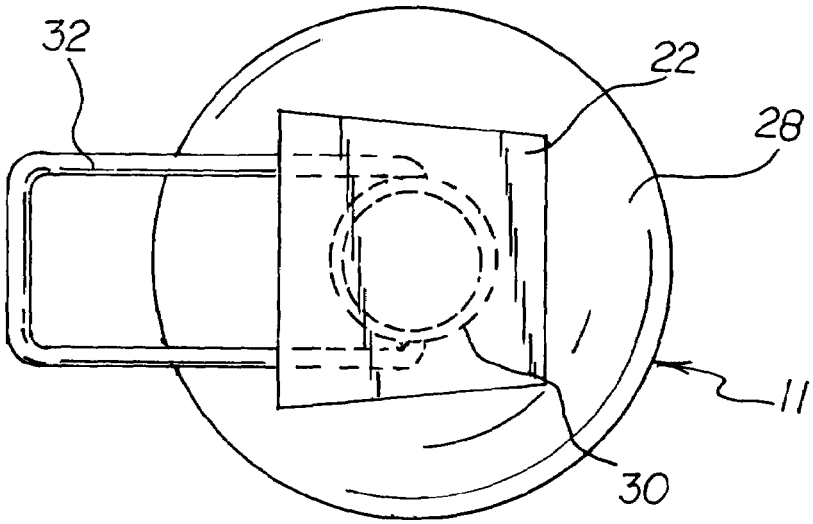
FIG 4

FIG 5
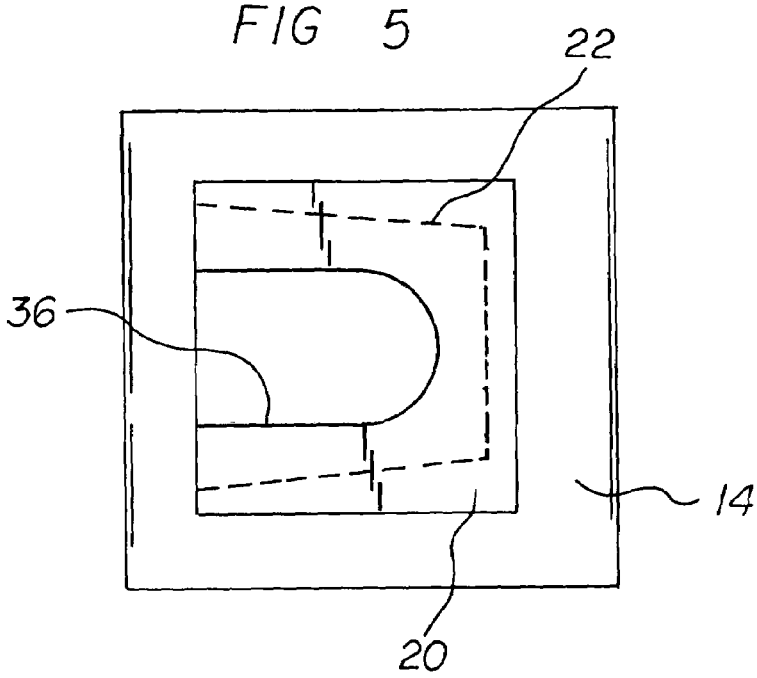
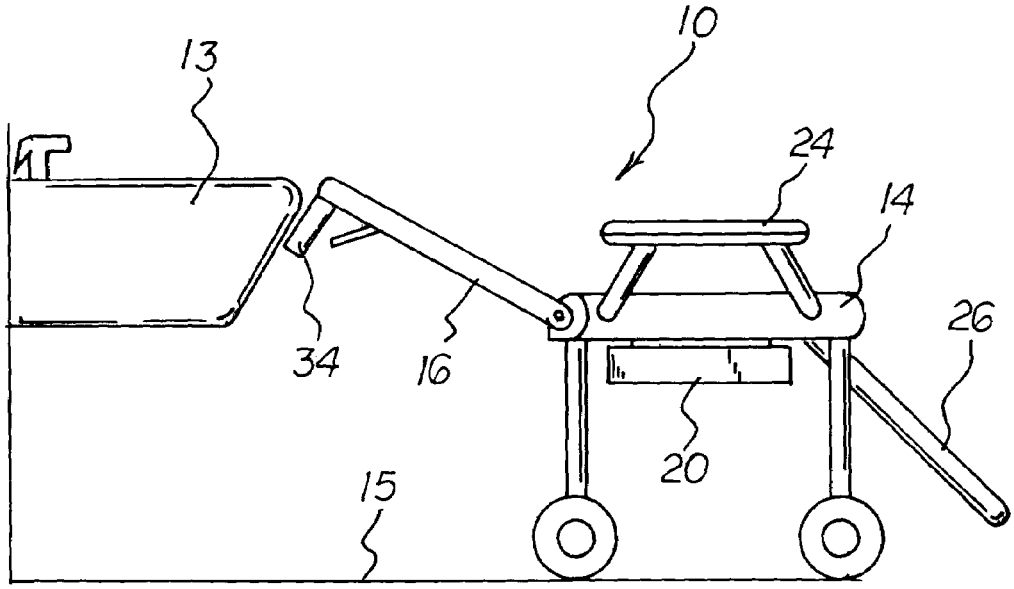
FIG 6

ELEVATABLE-STAND-ADAPTED, WHEELED CHAIR APPARATUS

CROSS-REFERENCE TO RELATED APPLICATION

This application claims priority based upon my copending Provisional Application Ser. No. 60/730,521, filed Oct. 27, 2005.

BACKGROUND OF THE INVENTION

1. Field of the Invention

The present invention relates generally to chairs used in beauty shops or barber shops, and, more particularly, to chairs adapted to be raised and lowered, moved along a floor, and tilted at a sink.

2. Description of the Prior Art

It is known in the prior art for devices to be employed with wheeled chairs, e. g. wheelchairs, to enable tilting of the wheelchairs and the persons seated in the wheelchairs. In this respect, the following U.S. patent disclose such devices: U.S. Pat. Nos. 4,192,549, 4,834,411, 5,040,939, and 5,472,307. More specifically, each of U.S. Pat. Nos. 4,192,549, 4,834, 411, 5,040,939, and 5,472,307 discloses a device for tilting wheelchairs; that is, the entire wheelchair and any person seated in the wheelchair is tilted by the respective devices. When a person seated in a wheelchair is to be tilted so that the person's hair can be washed in a sink, such as a beauty parlor or a barber shop, the device that tilts the wheelchair and the person sitting therein must be located near the sink and must be positioned in a location near the sink so that the tilted person's head will be located near the edge of the sink. Since persons seated in wheelchairs come in all shapes and sizes, it is a difficult design problem to proportion and position a wheelchair tilting device near a sink so that a tilted person's head will be located at the edge of the sink. More specifically, it would be desirable is a person tilting device were provided that does not require the combination of an entire wheeled chair and a person seated in the wheeled chair to be tilted when a person seated in a wheeled chair is to have one's head tilted to the edge of a sink.

In the environment of a beauty parlor or barber shop, it is often desirable for a patron to be seated in a first chair, e.g. a beautician's work chair, whose height can be raised and lowered so that head of the patron is conveniently located with respect to the working hands of the beautician for cosmetological activity. This first chair is separate and distinct from a second chair, which is located adjacent to a sink, wherein a patron's hair is washed. Often the first chair and the second chair are located a substantial distance from each other so that the patron must walk back and forth between the first chair and the second chair. To avoid the need for a patron to walk back and forth between a first chair and a second chair, it would be desirable if a single chair could be provided that permits a patron to be raised and lowered so that a beautician's working hands and the head of a patron are positioned conveniently with respect to each other, that permits a patron to be wheeled to a location adjacent to a hair washing sink, and that permits the single chair to be tilted so that the patron's head extends into the hair washing sink to enable hair washing therein.

U.S. Pat. No. 6,463,597 discloses a hair washing apparatus in which a single seat is located adjacent to a hair washing sink, and the seat can be raised and lowered with respect to the sink. It is noted that the seat is so close to the sink, and that the sink is in a fixed location with respected to plumbing, it would be very difficult for a beautician to use the seat for working on a patron. This so because the beautician does not have full 360 degree access to the patron. Without 360 degree access to the patron, it may be very difficult for a beautician to provide adequate service to a patron. In this respect, it would be desirable for a single chair to be provided that can be raised and lowered vertically, that permits a beautician to have 360 degree access to the patron, and that can be tilted to allow a patron's head to extend into a sink for washing.

Still other features would be desirable in a wheeled chair apparatus especially useful in beauty shops and barber shops. For example, it would be desirable for a wheeled chair apparatus to be adapted to be selectively both readily placed upon and readily removed from an elevatable stand. In this respect, in addition, it would be desirable for a wheeled chair apparatus to be easily attached to and detached from an elevatable stand.

Thus, while the foregoing body of prior art indicates it to be well known to use a wheeled chair apparatus, the prior art described above does not teach or suggest an elevatable-stand-adapted, wheeled chair apparatus which has the following combination of desirable features: (1) does not require the proportioning and locating of a wheeled chair tilting device to be near a sink so that the head of a person seated in the wheeled chair will be located at the edge of the sink when the wheeled chair and seated person are tilted together; (2) provides a person tilting device that does not require the combination of an entire wheeled chair and a person seated in the wheeled chair to be tilted when a person seated in a wheeled chair is to have one's head tilted to the edge of a sink; (3) permits a patron to be raised and lowered so that a beautician's or barber's working hands and the head of a patron are positioned conveniently with respect to each other, that permits a patron to be wheeled to a location adjacent to a hair washing sink, and that permits the single chair to be tilted so that the patron's head extends into the hair washing sink to enable hair washing therein; (4) can be raised and lowered vertically, that permits a beautician or barber to have 360 degree access to the patron, and that can be tilted to allow a patron's head to extend into a sink for washing; (5) provides a wheeled chair apparatus that is adapted to be selectively readily placed upon and readily removed from an elevatable stand; and (6) is easily attached to and detached from an elevatable stand. The foregoing desired characteristics are provided by the unique elevatable-stand-adapted, wheeled chair apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a wheeled chair apparatus which is adapted for connection with an elevatable stand, and the subject wheeled chair apparatus includes a wheeled chair unit which includes a seat portion and a reclinable seat back portion connected to the seat portion. A wheel assembly is connected to the seat portion, and elevatable stand attachment means are connected to a bottom side of the seat portion. The elevatable stand attachment means are adapted for connection with the elevatable stand. By using the elevatable-stand-adapted, wheeled chair apparatus of the invention, substantial amounts of time, effort, and stress on a person in wheeled chair are reduced in carrying out a cosmetological activity, such as by a beautician or a barber, on the person who is sitting in a wheeled chair, when compared with conventional procedures.

Preferably, the wheeled chair unit further includes arm rests and a foot rest connected to the seat portion. Also, preferably, the wheeled chair unit further includes push/pull handles connected to the reclinable seat back portion.

The elevatable stand can be a hydraulic stand. The elevatable stand attachment means can include an elevatable stand reception sleeve. The elevatable stand reception sleeve includes a hydraulic-piston-assembly reception slot for receiving a portion of the hydraulic piston assembly when the stand connector plate is inserted into the elevatable stand reception sleeve.

The elevatable stand reception sleeve can have an internal, wedge-shaped reception region; and the stand connector plate can have a wedge-shape that is complementary to the internal, wedge-shaped reception region of the elevatable stand reception sleeve.

More specifically, the hydraulic stand includes a stand connector plate, and the elevatable stand reception sleeve receives the stand connector plate, whereby the stand connector plate is connected to the elevatable stand reception sleeve.

More specifically, the hydraulic stand includes a stand base, and a hydraulic piston assembly is supported by the stand base. The stand connector plate is supported by the hydraulic piston assembly, and a hydraulic jack handle is connected to the hydraulic piston assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved elevatable-stand-adapted, wheeled chair apparatus which has all of the advantages of the prior art and none of the disadvantages.

It is another object of the present invention to provide a new and improved elevatable-stand-adapted, wheeled chair apparatus which may be easily and efficiently manufactured and marketed.

It is a further object of the present invention to provide a new and improved elevatable-stand-adapted, wheeled chair apparatus which is of durable and reliable construction.

An even further object of the present invention is to provide a new and improved elevatable-stand-adapted, wheeled chair apparatus which is susceptible of a low cost of manufacture with regard to both materials and labor, and which accordingly is then susceptible of low prices of sale to the consuming public, thereby making such elevatable-stand-adapted, wheeled chair apparatus available to the buying public.

Still yet a further object of the present invention is to provide a new and improved elevatable-stand-adapted, wheeled chair apparatus which does not require the proportioning and locating of a wheeled chair tilting device to be near a sink so that the head of a person seated in the wheeled chair will be located at the edge of the sink when the wheeled chair and seated person are tilted together.

Still another object of the present invention is to provide a new and improved elevatable-stand-adapted, wheeled chair apparatus that provides a person tilting device that does not require the combination of an entire wheeled chair and a person seated in the wheeled chair to be tilted when a person seated in a wheeled chair is to have one's head tilted to the edge of a sink.

Yet another object of the present invention is to provide a new and improved elevatable-stand-adapted, wheeled chair apparatus which permits a patron to be raised and lowered so that a beautician's or barber's working hands and the head of a patron are positioned conveniently with respect to each other, that permits a patron to be wheeled to a location adjacent to a hair washing sink, and that permits the single chair to be tilted so that the patron's head extends into the hair washing sink to enable hair washing therein.

Even another object of the present invention is to provide a new and improved elevatable-stand-adapted, wheeled chair apparatus that can be raised and lowered vertically, that permits a beautician or barber to have 360 degree access to the patron, and that can be tilted to allow a patron's head to extend into a sink for washing.

Still a further object of the present invention is to provide a new and improved elevatable-stand-adapted, wheeled chair apparatus which provides a wheeled chair apparatus that is adapted to be selectively readily placed upon and readily removed from an elevatable stand.

Yet another object of the present invention is to provide a new and improved elevatable-stand-adapted, wheeled chair apparatus that is easily attached to and detached from an elevatable stand.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the elevatable-stand-adapted, wheeled chair apparatus of the invention, connected to a hydraulic stand and raised on the hydraulic stand above floor level.

FIG. 2 is an enlarged, partial cross-sectional view of the embodiment of the shown in FIG. 1 taken along line 2-2 of FIG. 1, showing the connection between the hydraulic stand and the elevatable-stand-adapted, wheeled chair apparatus of the invention.

FIG. 3 is a side view of the embodiment of the invention of FIG. 1, wherein the embodiment of the invention has been lowered to floor level and has been wheeled away from the hydraulic stand.

FIG. 4 is top view of the hydraulic stand of the invention shown in FIG. 3 taken along line 4-4 thereof.

FIG. 5 is a bottom view of the embodiment of the elevatable-stand-adapted, wheeled chair apparatus of the invention shown in FIG. 3, taken along line 5-5 thereof.

FIG. 6 is a side view of the embodiment of the invention shown in FIG. 3, wherein the embodiment of the invention has been wheeled up to a shampoo sink, and wherein the reclining back of the seat portion has been reclined to the shampoo sink.

DESCRIPTION OF THE PREFERRED EMBODIMENT

With reference to the drawings, a new and improved elevatable-stand-adapted, wheeled chair apparatus embodying the principles and concepts of the present invention will be described.

Turning to FIGS. 1-6, there is shown a preferred embodiment of the elevatable-stand-adapted, wheeled chair apparatus of the invention generally designated by reference numeral 10. In each of the figures, reference numerals are shown that correspond to like reference numerals that designate like elements shown in other figures.

In the preferred embodiment, a wheeled chair apparatus 10 is adapted for connection with an elevatable stand, and the subject wheeled chair apparatus includes a wheeled chair unit which includes a seat portion 14 and a reclinable seat back portion 16 connected to the seat portion 14. A wheel assembly 18 is connected to the seat portion 14, and elevatable stand attachment means are connected to a bottom side of the seat portion 14. The elevatable stand attachment means are adapted for connection with the elevatable stand.

Preferably, the wheeled chair unit further includes arm rests 24 and a foot rest 26 connected to the seat portion 14. Also, preferably, the wheeled chair unit further includes push/pull handles 34 connected to the reclinable seat back portion 16.

The elevatable stand can be a hydraulic stand 11. The elevatable stand attachment means can include an elevatable stand reception sleeve 20. The elevatable stand reception sleeve 20 includes a hydraulic-piston-assembly reception slot 36 for receiving a portion of the hydraulic piston assembly 30 when the stand connector plate 22 is inserted into the elevatable stand reception sleeve 20.

The elevatable stand reception sleeve 20 can have an internal, wedge-shaped reception region; and the stand connector plate 22 can have a wedge-shape that is complementary to the internal, wedge-shaped reception region of the elevatable stand reception sleeve 20.

More specifically, the hydraulic stand 11 includes a stand connector plate 22, and the elevatable stand reception sleeve 20 receives the stand connector plate 22, whereby the stand connector plate 22 is connected to the elevatable stand reception sleeve 20. In this respect, the elevatable stand reception sleeve 20 is a female reception sleeve, and the stand connector plate 22 is a male connector member.

More specifically, the hydraulic stand 11 includes a stand base 28, and a hydraulic piston assembly 30 is supported by the stand base 28. The stand connector plate 22 is supported by the hydraulic piston assembly 30, and a hydraulic jack handle 32 is connected to the hydraulic piston assembly 30.

To use the elevatable-stand-adapted, wheeled chair apparatus 10 of the invention, a person (not shown), such as a patient in a health care facility, is seated on the seat portion 14 of the apparatus. The feet of the person can rest on the foot rest 26. The arms of the person can rest on the arm rests 24. The back of the person can rest on the reclinable seat back portion 16.

Once the person is seated in the apparatus, a helper can grasp the push/pull handles 34 and wheel the apparatus to a location where an activity will take place.

When the activity for the person is shampooing the person, the helper wheels the apparatus to a shampoo sink 13, such as shown in FIG. 6. The reclinable seat back portion 16 is reclined so that the head of the person is positioned over the basin of the sink.

When the activity for the person is hair cutting or hair coloring, or some other cosmetological activity in which the person receives the cosmetological activity while the person is seated on an elevatable stand, such as the hydraulic stand 11, then the helper wheels the apparatus to the hydraulic stand 11 such that the stand connector plate 22 on the hydraulic stand 11 fits into elevatable stand reception sleeve 20 on the wheeled chair unit.

Once the stand connector plate 22 is fit into the elevatable stand reception sleeve 20, the hydraulic jack handle 32 can be operated so that the hydraulic piston assembly 30 elevates the wheeled chair unit above the floor level, as shown in FIG. 1.

When the cosmetological activity requiring the hydraulic stand 11 is completed, the hydraulic jack handle 32 is operated to lower the wheeled chair unit so that the wheel assembly 18 contacts the floor 15. Then, the wheeled chair unit can be wheeled away from the hydraulic stand 11, whereby the elevatable stand reception sleeve 20 disengages from the stand connector plate 22.

By using the elevatable-stand-adapted, wheeled chair apparatus 10 of the invention, substantial amounts of time, effort, and stress on a person in wheeled chair are reduced in carrying out a cosmetological activity on the person who is sitting in a wheeled chair, when compared with conventional procedures. With the conventional procedures, the person in the wheeled chair must be lifted and transferred to a chair has an elevatable stand in order to carry out the cosmetological activity. Often more than one helper is needed to lift and transfer the person from the wheeled chair. Then, after the cosmetological activity has been completed, the person must be transferred back to the wheeled chair from the chair has an elevatable stand. Also, often, more than one helper is needed to transfer the person back to the wheeled chair.

This conventional double transfer of a person from the person's chair and back to the person's chair is eliminated for each cosmetological activity when the elevatable-stand-adapted, wheeled chair apparatus 10 of the invention is employed. In this respect, for plural cosmetological activities, the double transfer is eliminated for each of the plural cosmetological activities.

It will be appreciated that the present invention contemplates that a conventional stylist or salon chair may be fitted with a female plate attached to its underside suitable for engagement with a male plate on the hydraulic stand. In this manner, a cosmetologist may use the salon chair for non-wheelchair clients. Thus, when a wheelchair client is ready for a hair styling procedure, the conventional salon chair may easily be removed from the base or stand and replaced by the wheelchair version. This is important because most care centers already have existing beauty salons and the styling chairs already in place may be adapted for use in accordance with the present invention rather than investing in new, expensive equipment.

The components of the hydraulic stand adapted, wheeled chair apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved elevatable-stand-adapted, wheeled chair apparatus that is low in cost, relatively simple in design and operation, and which may advantageously be used without requiring a proportioning and locating of a wheeled chair tilting device to be near a sink so that the head of a person seated in the wheeled chair will be located at the edge of the sink when the wheeled chair and seated person are tilted together. With the invention, a elevatable-stand-adapted, wheeled chair apparatus provides a person tilting device that does not require the combination of an entire wheeled chair and a person seated in the wheeled chair to be tilted when a person seated in a wheeled chair is to have one's head tilted to the edge of a sink. With the invention, a elevatable-stand-adapted, wheeled chair apparatus is provided which permits a patron to be raised and lowered so that a beautician's or barber's working hands and the head of a patron are positioned conveniently with respect to each other, that permits a patron to be wheeled to a location adjacent to a hair washing sink, and that permits the single chair to be tilted so that the patron's head extends into the hair washing sink to enable hair washing therein. With the invention, a elevatable-stand-adapted, wheeled chair apparatus is provided which can be raised and lowered vertically, that permits a beautician or barber to have degree access to the patron, and that can be tilted to allow a patron's head to extend into a sink for washing. With the invention, a elevatable-stand-adapted, wheeled chair apparatus provides a wheeled chair apparatus that is adapted to be selectively readily placed upon and readily removed from an elevatable stand. With the invention, a elevatable-stand-adapted, wheeled chair apparatus is provided which is easily attached to and detached from an elevatable stand.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A wheeled chair apparatus combined with an elevatable stand, comprising:

a wheeled chair unit which includes a seat portion, a reclinable seat back portion connected to said seat portion, and a wheel assembly connected to said seat portion, and elevatable stand attachment means connected to a bottom side of said seat portion, wherein said elevatable stand attachment means are combined with the elevatable stand said elevatable stand attachment means includes an elevatable stand reception sleeve, and the elevatable stand includes a stand connector plate for engagement with said elevatable stand reception sleeve, wherein said elevatable stand reception sleeve includes a hydraulic piston-assembly reception slot for receiving a portion of a hydraulic piston assembly when said stand connector plate is inserted into said elevatable stand reception sleeve.

2. The apparatus of claim 1 wherein said wheeled chair unit further includes arm rests.

3. The apparatus of claim 1 wherein said wheeled chair unit further includes a foot rest.

4. The apparatus of claim 1 wherein said wheeled chair unit further includes push/pull handles connected to the reclinable seat back portion.

5. The apparatus of claim 1 wherein the elevatable stand is a hydraulic stand.

6. The apparatus of claim 1 wherein the hydraulic stand includes a hydraulic piston assembly.

7. The apparatus of claim 6 wherein:

said elevatable stand reception sleeve has an internal, wedge-shaped reception region, and said stand connector plate has a wedge-shape that is complementary to said internal, wedge-shaped reception region of said elevatable stand reception sleeve.

8. The apparatus of claim 6 wherein said elevatable stand reception sleeve receives the stand connector plate, whereby the stand connector plate is connected to said elevatable stand reception sleeve.

9. The apparatus of claim 6 wherein the hydraulic stand includes:

a stand base, a hydraulic piston assembly supported by said stand base, said stand connector plate supported by said hydraulic piston assembly, and a hydraulic jack handle connected to said hydraulic piston assembly.

* * * * *